US011927072B2

(12) United States Patent
Candido Gomes

(10) Patent No.: US 11,927,072 B2
(45) Date of Patent: Mar. 12, 2024

(54) VALVE FOR DOWNHOLE CHEMICAL INJECTION CONTROL

(71) Applicant: OURO NEGRO TECNOLOGIAS EM EQUIPAMENTOS INDUSTRIAIS S/A, Rio de Janeiro (BR)

(72) Inventor: Leonardo Goncalves Candido Gomes, Maracana (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 189 days.

(21) Appl. No.: 17/417,639

(22) PCT Filed: Dec. 30, 2019

(86) PCT No.: PCT/BR2019/050576
§ 371 (c)(1),
(2) Date: Jun. 23, 2021

(87) PCT Pub. No.: WO2020/140142
PCT Pub. Date: Jul. 9, 2020

(65) Prior Publication Data

US 2022/0112787 A1 Apr. 14, 2022

(30) Foreign Application Priority Data

Jan. 2, 2019 (BR) ..... 102019000052-0

(51) Int. Cl.
*E21B 34/06* (2006.01)
*E21B 47/07* (2012.01)

(52) U.S. Cl.
CPC ..... *E21B 34/066* (2013.01); *E21B 47/07* (2020.05); *E21B 2200/04* (2020.05)

(58) Field of Classification Search
CPC .. E21B 34/066; E21B 2200/04; E21B 43/162; E21B 43/164; E21B 43/166; E21B 43/168; E21B 43/255
See application file for complete search history.

(56) References Cited

U.S. PATENT DOCUMENTS 3,270,772 A * 9/1966 Rakus ..... F16K 5/0615 137/553
5,996,687 A * 12/1999 Pringle ..... E21B 34/06 251/117

(Continued)

*Primary Examiner* — Kenneth L Thompson
(74) *Attorney, Agent, or Firm* — Dale Paul DiMaggio; Malin Haley DiMaggio & Bowen, P.A.

(57) ABSTRACT

A valve for downhole chemical injection control, having a single chemical injection fluid line (2) to feed all the injection points, regardless of the number of zones, exclusively electrically-driven by a single electric cable (3), with embedded sensing electronics (7), which communicate and activate an electric motor (4), coupled to a multi-position sphere (5) for dosing the chemical injection fluid, which, according to the electric motor rotation, is moved, altering its position, to enable the passage of interest to be selected, according to the volume of chemical fluid to be injected, a single turn of the sphere being required to commute all the possible positions, the performance of which is low in power consumption, and for a short period of time, having after its positioning in the desired passage zero consumption to maintain this position.

11 Claims, 4 Drawing Sheets

(56) References Cited

U.S. PATENT DOCUMENTS

| | | | | |
|---|---|---|---|---|
| 6,041,857 | A * | 3/2000 | Carmody | E21B 34/066 166/324 |
| 6,138,754 | A * | 10/2000 | Veneruso | F16K 31/04 417/63 |
| 8,286,709 | B2 | 10/2012 | Mennem et al. | |
| 8,602,107 | B2 * | 12/2013 | Reid | E21B 34/10 137/625.21 |
| 8,733,448 | B2 * | 5/2014 | Skinner | E21B 34/066 166/373 |
| 9,453,388 | B2 * | 9/2016 | Tahoun | E21B 34/06 |
| 10,400,900 | B2 * | 9/2019 | Kindersley | F16K 5/0689 |
| 11,060,367 | B2 * | 7/2021 | Rakhunde | E21B 33/0355 |
| 11,578,569 | B2 * | 2/2023 | Rodger | E21B 34/066 |
| 2016/0010427 | A1 * | 1/2016 | Kelbie | E21B 34/066 166/373 |
| 2017/0074070 | A1 * | 3/2017 | Hay | E21B 21/08 |

* cited by examiner

VALVE FOR DOWNHOLE CHEMICAL INJECTION CONTROL

FIELD OF THE INVENTION

Specification of patent of invention for a valve, exclusively electrically-driven, for downhole chemical injection control, offshore or onshore, both injectors and producers.

BACKGROUND OF THE INVENTION

The technological evolution of the oil and gas sector has enabled sustainable exploitation of areas thus far considered unfeasible for production, higher levels of recovery and production having been obtained, but under increasingly severe conditions.

In addition to the increase in pressure and temperature levels found in wells, other difficulties were gradually encompassed into the segment such as higher levels of vibration, acid concentration, and others.

Throughout the productive life of a well, its operators face the most adverse types of problems, and for some, small corrective actions have positive effects, but when this is not possible, it is necessary to interrupt production, and mobilize an entire infrastructure for the implementation of the intervention required.

One of the most frequently occurring problems, and which generates major impact on the oil production chain, is the formation of incrustations, usually occurring inside the columns, in the subsea valve sets and in the flow lines, in the face of high pressure, low temperature, turbulent runoff and the composition of fluids, combined or not. Such incrustation may cause obstruction of passages, malfunction of equipment and others, interfering directly in the production and safety levels of the well, which are indicators of great importance.

In addition to the incrustations, another serious problem is the oxidation of the components, the deterioration of which compromises its functionalities and, in the majority of the cases, when detected, it is in an advanced stage, or under failures, making immediate intervention necessary to replace or repair the components.

In order to mitigate and reduce the problems arising from incrustations and oxidations, reagent and inhibitor fluids were developed, intended for injection in well, which act directly in the delay and dissolution of incrustation formations and/or in reducing the level of oxidation of the environment.

Relating the chemical injection action to the high reliability of production line equipment, a scenario with reduced intervention potential is obtained, which is of extreme interest to the oil and gas industry.

Considering the high levels of daily production of a single well, an unplanned interruption generates a major negative impact under the finances of its responsible party, and, depending on the type of occurrence, even higher expenses may be incurred due to the need for commissioning of special vessels, and replacement of defective components.

Moreover, during the execution of the intervention, safety levels are considerably reduced, it can generates critical conditions, in this context, it is highly justifiable and necessary to invest more in the research and development for equipment that generate a higher degree of reliability, with reduction in the number of interventions, providing the return of capital investment through continued production and security.

PRIOR ARTS

Conventional means of chemical injection into wells employ one or two one-way valves of the "Check" type, the first responsible for controlling opening and closing, and the second as redundancy, said valves work on an intermittent opening and closing regime, which directly relates them to the main problems that affect them, such as inaccuracy in the control of the volume injected, wear of the elements responsible for the performance and sealing, discontinuity in operating pressure, in addition to others.

In conventional systems, each injection point of the column requires a valve set, as described earlier, and line dedicated thereto, that is originated on the part of the production unit, powered by power units, extend to the point of injection, descending through the umbilical, passing through the Christmas tree, column suspender, following the column downwards.

Currently there are chemical injection means in well, called multipoint, which require only a single injection line for the whole column, such as, for example, the development described in the patent document U.S. Pat. No. 8,286,709, which discloses the multipoint chemical injection system, designed to provide chemical treatment along the well for a plurality of injection zones, including injection in the column, as well as in the annular, performed in a single control line, from the surface to the downhole, accordingly having a fluid dosage valve that restricts the amount of chemical treatment fluid injected into the well zone, and it forces/makes the remaining portion to move to the division part, leaving the connector that connects, upstream, the next chemical injection valve. Thus, in operation, the chemical treatment fluid enters the chemical injection valve, by way of a single control line, passes through the check valves, being blocked by the fluid measurement valve that allows only specific quantity of the fluid to be directed to the zone surrounding the well, while the remaining part of the fluid moves around the check valves and fluid measuring valve, through the passage of derivation, coupled to the next chemical injection valve, by way of a single control line segment, the next chemical injection valve performing the same function of injecting a specific quantity of the chemical injection fluid, skirting the remaining part, this process being repeated until the lower chemical injection valve, which requires no diversion passage, thus allowing simultaneous injection of chemical treatment fluid into a plurality of well zones with the single hydraulic line, and the fluid dosing valves from chemical injection valves can be selected to provide a desired amount of chemical treatment fluid in each well zone, and additionally the fluid dosing valves provide desired restrictions to the flow so that they can be used in cooperation to offset the differences in pressure of the reservoir in the various zones of the well, and can also be designed to offset pressure loss associated with restrictions and/or friction between the chemical fluid treatment and the control line, to ensure that a desired amount of chemical treatment fluid is delivered each zone, and the lower chemical injection valve may alternatively comprise the emergency output orifice, arranged between the fluid dosing valve and the check valve, to release the chemical treatment fluid in the zone surrounding the well, in case fluid flow through the lower chemical injection valve is blocked.

Despite the good results obtained, the systems of current techniques still present limitations regarding the alteration of the injection region without intervention, in addition to the control of volume injected, in simultaneous injections or not, with variations in pressure and temperature of the reservoir, motivated by the long production time or occurrence of some unexpected incident.

SUMMARY OF THE INVENTION

The valve for downhole chemical injection control now proposed, is exclusively electrically-driven, by means of only a single electric cable, and using a single chemical injection fluid line to feed all the injection points, regardless of the number of zones in the well.

The valve for downhole chemical injection line now proposed, incorporates a mechanism, driven by an electric motor, coupled to a multiposition sphere for dosing the chemical injection fluid, which will be rotated, in accordance with the engine rotation, altering its position, to enable the passage of interest to be selected, in accordance with the flow rate of chemical treatment to be injected, a single turn of the multiposition sphere being required to commute between all the possible positions, the performance of which is low in power consumption, for a short period of time, having after positioning in the desired passage zero consumption for maintenance thereof in this position.

The valve for downhole chemical injection line now proposed, incorporates on its inside embedded sensing electronics, connected to a single electric cable, configuring man-machine interface for communication and feed between the downhole chemical injection valve and the surface system.

The embedded sensing electronics are connected to the driving mechanism, and control the position of the chemical injection fluid multiposition dosing sphere by means of controlling the rotation of the electric motor.

The embedded sensing electronics further contain sensors for temperature, pressure, vibration and chemical concentration, not being restricted thereto, which collect data from the injection point region and relay to the surface system, configuring man-machine interface for analysis and action; said action may be maintenance or change of position of the multiposition chemical injection fluid dosing sphere or of the chemical fluid injected. Alternatively, this analysis and consequent action may be made by the embedded sensing electronics themselves.

All and any variation in temperature, pressure vibration and chemical concentration, not being restricted thereto, detected by the embedded sensing electronics reveals a potential alteration in the behavior of the well with possible need for action.

The device dosing sphere has hollow sections, configuring passages having varied sizes and profiles, suited to the desired flow, enabling control of the volume of the chemical fluid injected, whether or not the injection is simultaneous to other zones.

With a view to enhancing the degree of working reliability of valve set for downhole chemical injection control now proposed, a one-way safety valve (not illustrated) can be installed at the beginning of the single line of chemical injection fluid, before the first injection point, to form a general barrier that prevents possible influx (production) by it in case of failure.

The valve for downhole chemical injection control now proposed incorporates on its inside a one-way valve, which forms a safety barrier by injection point, which enhances the reliability and prevents communication between the zones and/or influx by the common single injection line.

The valve for downhole chemical injection control now proposed provides means for enabling the injection of the chemical fluid, both in the column and in the annular without the need for intervention, by positioning the sphere.

BRIEF DESCRIPTION OF THE DRAWINGS

For an improved understanding of the valve for downhole chemical injection control now proposed, reference is made to the accompanying drawings, wherein.

DETAILED DESCRIPTION OF THE INVENTION

Figure 1:
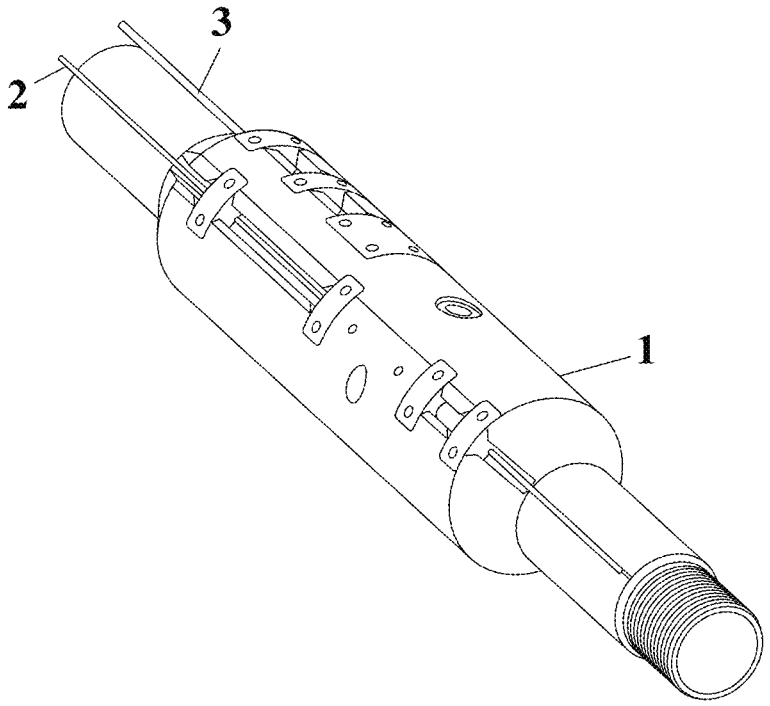
FIG. 1 illustrates a perspective view of the valve for downhole chemical injection control of the present invention.
Figure 2:
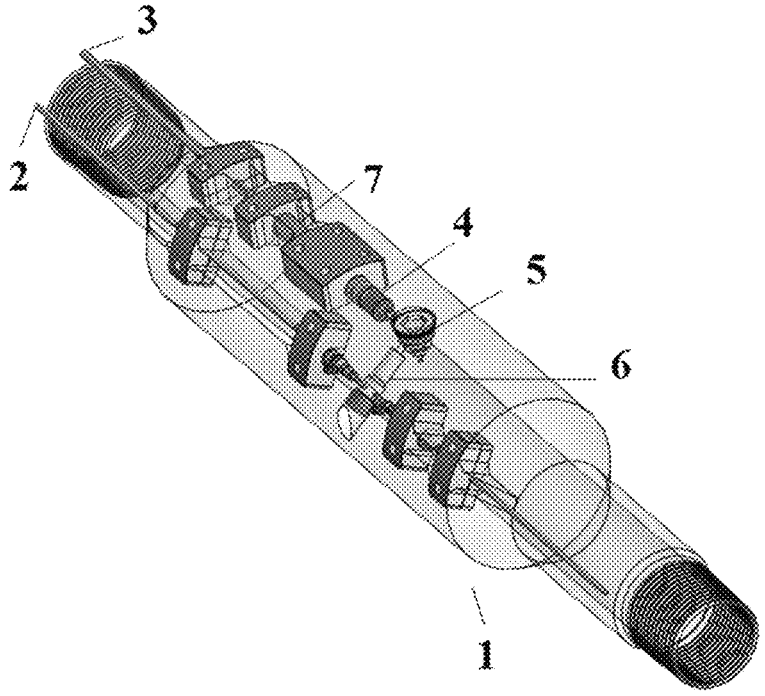
FIG. 2 illustrates a perspective view of the valve for downhole chemical injection control of the present invention, in transparency, showing the chemical fluid line, the actuating mechanism of the dosing sphere for injecting the chemical fluid in the column, and the embedded sensing electronics.
Figure 3:
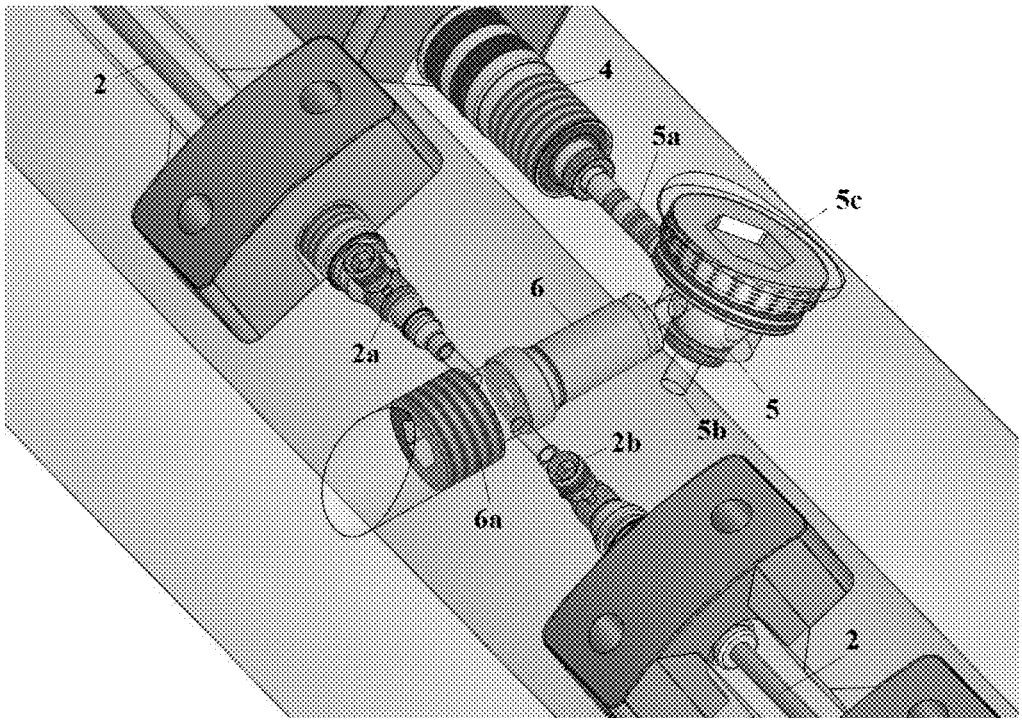
FIG. 3 illustrates expanded perspective view of the single line of chemical injection fluid and of the actuating mechanism of the dosing sphere for injecting the chemical fluid in the column.
Figure 4:
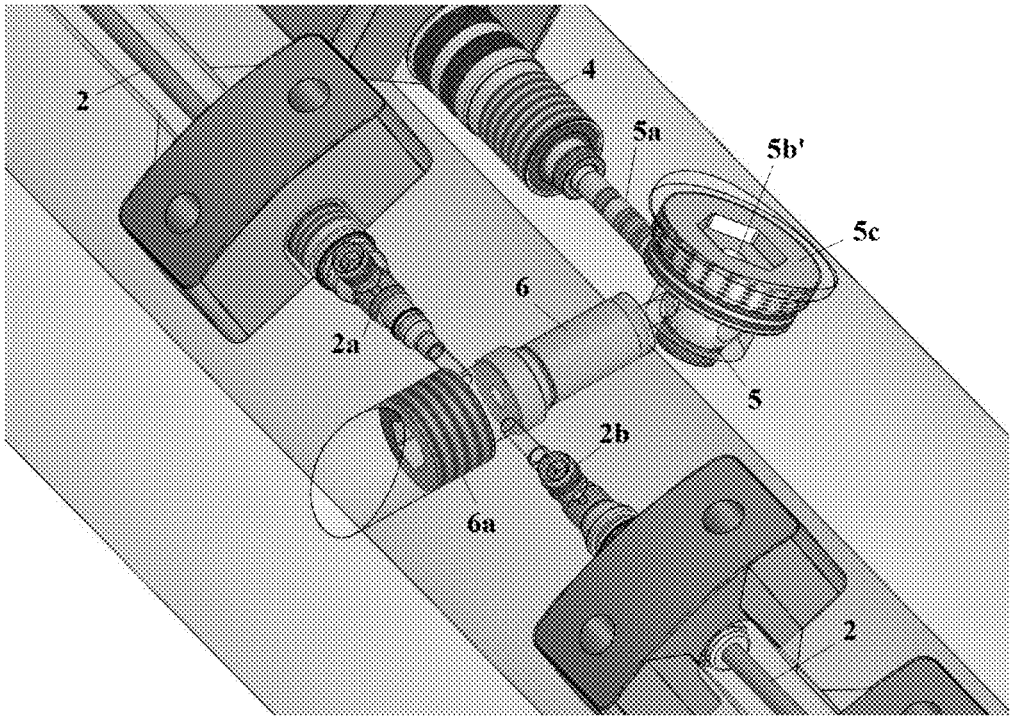
FIG. 4 illustrates expanded perspective view of the single line of chemical injection fluid and of the actuating mechanism of the dosing sphere for injecting the chemical fluid into the annular.
Figure 5:
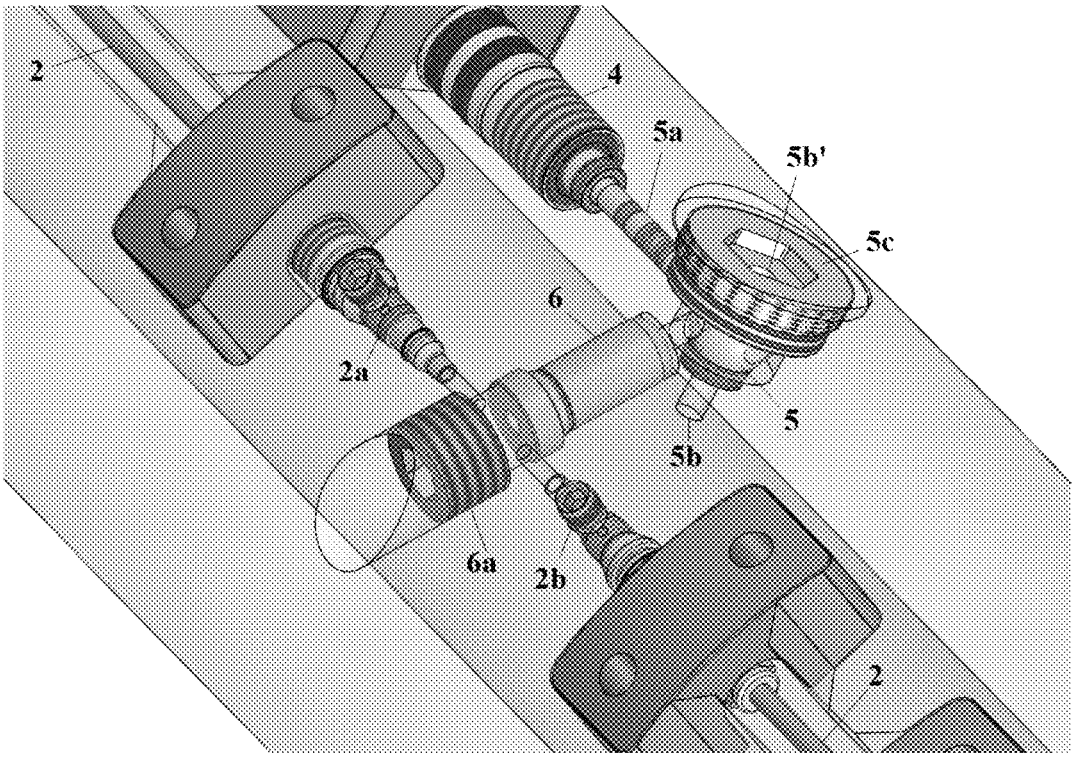
FIG. 5 illustrates expanded perspective view of the single line of chemical injection fluid and of the actuating mechanism of the dosing sphere for injecting the chemical fluid, in the column and in the annular.
Figure 6:
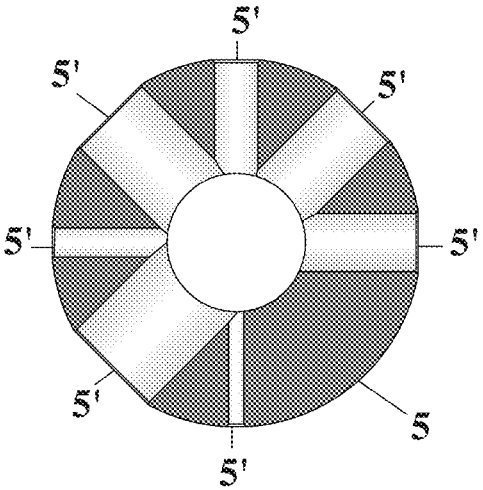
FIG. 6 illustrates a longitudinal section view of the dosing sphere of the chemical injection fluid of the valve for downhole chemical injection control of the present invention, for injection into the column or into the annulus.
Figure 7:
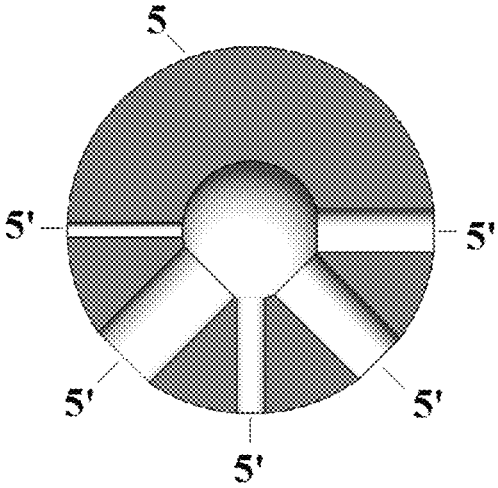
FIG. 7 illustrates a longitudinal section view of the dosing sphere of the chemical injection fluid of the valve for downhole chemical injection control of the present invention, for injecting into the column and into the annulus, without the need for intervention.
Figure 8:
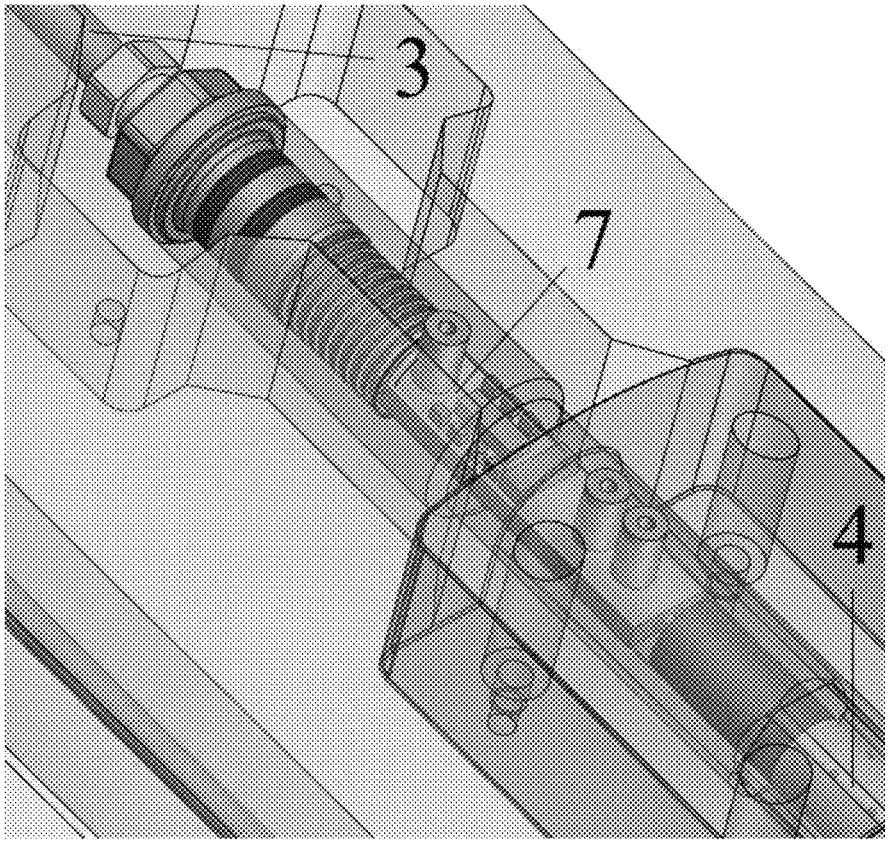
FIG. 8 illustrates expanded perspective view of the embedded electronics with sensing driven by single electric cable, installed in the actuator mechanism of the dosing sphere for chemical fluid injection.

The valve (1) for downhole chemical injection control now proposed uses only a single injection chemical fluid line (2) to feed all the injection points, regardless of the number of zones in the well, besides being exclusively-electrically driven, by way of single electric cable (3) for power transmission and communication.

The valve (1) for downhole chemical injection control now proposed uses a dosing mechanism, driven by electric motor (4), coupled to the multiposition choke sphere (5) for dosing the chemical injection fluid, which, with the engine rotation, is rotated, by means of the transmission shaft (5*a*), altering its position, for selecting the passage (5') of interest, in accordance with the flow of chemical fluid to be injected, a single turn of the sphere being required to commute between all the possible positions, the performance of which is low in power consumption, and executed for a short period of time, having after its positioning at the desired passage zero consumption for maintenance thereof in this position.

The valve (1) for downhole chemical injection control now proposed incorporates on its inside embedded sensing electronics (7), connected to the electric motor (4), for controlling the rotation of the electric motor (4), and consequent control of the position of the multiposition chemical injection fluid dosing sphere (5), said embedded sensing electronics (7) being man-machine interface for communication and feed between the downhole chemical injection valve (1) and the surface system.

The passages (5') of the dosing sphere (5) configure channels having sizes and profiles suited to the desired flow, enabling control of the volume of the chemical injection fluid, whether or not the injection is simultaneous to other zones, and of the injection region, column or annulus.

With a view to enhancing the degree of working reliability of the valve for downhole chemical injection control now proposed, the valve for downhole chemical injection control now proposed incorporates a one-way valve (6) preceding the fluid dosing sphere (5), communicative with the single chemical injection fluid line (2), operating as a safety valve, following by a sealing plug (6*a*), which maintains the integrity of the combination, said single chemical injection fluid line (2) being in fluid communication with said one-way valve (6) by means of hydraulic connectors (2*a*) which have double metallic seal and tube anchoring, further having a test port (2*b*) for validating the hydraulic connection, since this assembly is carried out on site (field), said one-way valve (1) establishing fluid communication path with said dosing sphere, whereby the chemical fluid may be injected, by way of the lower conduit (5*b*), in the column, or through the orifice (5*b'*) of the upper lid (5*c*), in the annulus, having both said lower conduit (5*b*) and said orifice (5*b'*) of the upper lid (5*c*) a greater size than the size of the larger passage of the said dosing sphere (5), so as not to interfere with the flow control of the chemical fluid injected.

The valve (1) for downhole chemical injection control now proposed further provides, in a unique constructive arrangement, the possibility of injecting chemical fluid by way of the lower conduit (5*b*) or through the orifice (5*b'*) of the upper lid (5*c*), using a dosing sphere (5) with passages (5') disposed in just one of its hemispheres.

The embedded sensing electronics (7) contain sensors for temperature, pressure, vibration and chemical concentration, not being restricted thereto, which collect data from the injection point region and relay to the surface system, configuring man-machine interface. Said embedded sensing electronics (7) may, besides collecting, process the data from the injection point region obtained by said sensors, and operate according to the result of the processing of these data.

The invention claimed is:

1. A valve for downhole chemical injection control, connected to a single chemical injection fluid line for feeding downhole well chemical fluid injection locations, exclusively electrically-driven, by a single electric cable for power transmission and control, with on-board sensing electronics, said valve comprising:

a multi-position dosing sphere having a plurality of fluid line passages, each having a fluid inlet, for dosing the chemical injection fluid, driven by an electric motor, which rotates said dosing sphere by a transmission shaft, for selecting a dosing sphere passage for the chemical injection fluid, a single turn of the dosing sphere commutes between all fluid inlets of all the possible positions of the fluid line passages;

each one of the dosing sphere fluid line passages configures a channel having a size and profile suited to the desired flow of chemical injection fluid;

a one-way single chemical injection line safety valve being installed from the single chemical injection fluid in connection with the dosing sphere;

wherein said one-way fluid line safety valve establishes a fluid communication path with the dosing sphere;

wherein the chemical fluid can be injected by way of a lower conduit in a column;

wherein the chemical fluid can be injected through an orifice of an upper lid in said dosing sphere into an annulus;

wherein said on-board sensing electronics are driven by a single electric cable; and, wherein the on-board sensing electronics collect data on temperature, pressure, vibration and chemical concentration.

2. A valve to control the injection of chemicals to reduce or eliminate encrustations and oxidation in an oil well downhole column or annulus, said valve comprising: a dosing sphere for injecting and controlling a chemical fluid;

said dosing sphere including a plurality of individual passages for receiving and transferring chemical fluid for injection into a column;

a single fluid chemical injection line, connected from a wellhead surface, into said valve, and in fluid communication with said dosing sphere and one selected dosing sphere passage;

an electric motor connected to a transition shaft that engages said dosing sphere for selection and rotation of said dosing sphere to align the single fluid chemical injection line with a single dosing sphere passage for receiving and transferring the injection chemical fluid to a column;

a single electric cable extending from said surface and connected to said electric motor, and sensing electronics mounted in said valve and connected to the electric motor and said single electric cable to control rotation of the motor and the position of the dosing sphere, said sensing electronics being a man machine interface for communication between the downhole chemical injection valve and a surface system.

3. The valve as in claim 2, wherein:

a single turn of the dosing sphere commutes between all the possible positions of the dosing sphere passages.

4. The valve as in claim 3, wherein:

each one of the dosing sphere passages configures a channel having a size and profile suited to the desired flow of the chemical injection fluid.

5. The valve as in claim 4, including:

a one-way safety valve connected between single chemical injection fluid line and the dosing sphere to stop the flow of chemical injection fluid if necessary for safety purposes from the dosing sphere.

6. The valve as in claim 5 wherein:

said sensing electronics collect data on temperature, pressure, vibration and chemical concentration.

7. A valve for downhole chemical injection control, to reduce or eliminate incrustations and oxidation in downhole columns, said valve comprising:

a single chemical injection fluid line connected to said valve, a multi-position dosing sphere, having a plurality of chemical injection fluid passages, for dosing the chemical injection fluid and in fluid communication with said single chemical injection fluid line;

an electric motor;

a single electrical cable extending from above ground, well side, connected to said electric motor; and a transmission shaft, connecting said electric motor to said multi-position dosing sphere to rotate said multi-position sphere for selecting a passage to receive and transmit chemical injection fluid into a column.

8. The valve as in claim 7, wherein:

said multi-position dosing sphere, in a single turn, commutes between all possible positions of said multi-position dosing sphere passages for receiving and transmitting chemical injection fluid into a column.

9. The valve as in claim 8, wherein:

each one of the multi-position dosing sphere passages configures a channel having a size and profile suited to the desired flow of chemical injection fluid.

10. The valve as in claim 8, including:

one-way safety valve connected at a first end to said single chemical injection fluid line and a second end in fluid communication path with the multi-position dosing sphere, in order to stop the flow of chemical injection fluid into said multi-position dosing sphere in case of emergency.

11. The valve as in claim 7, including:

onboard sensing electronics that collect data on temperature, pressure, vibration and chemical concentration, for power transmission and control connected to said single electric cable and said multi-position dosing sphere transmission motor.

* * * * *